US011345169B2

(12) United States Patent
Kobayashi et al.

(10) Patent No.: US 11,345,169 B2
(45) Date of Patent: May 31, 2022

(54) PLATEN AND PRINTER

(71) Applicant: Ricoh Company, Ltd., Tokyo (JP)

(72) Inventors: Takeyuki Kobayashi, Kanagawa (JP); Tetsu Morino, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/178,363

(22) Filed: Feb. 18, 2021

(65) Prior Publication Data

US 2021/0276346 A1 Sep. 9, 2021

(30) Foreign Application Priority Data

Mar. 5, 2020 (JP) ..... JP2020-037483

(51) Int. Cl.

| | |
|---|---|
| ***B41J 11/02*** | (2006.01) |
| ***B41J 3/407*** | (2006.01) |
| ***B41J 11/00*** | (2006.01) |
| *B41J 2/01* | (2006.01) |

(52) U.S. Cl.

CPC ..... *B41J 11/02* (2013.01); *B41J 3/4078* (2013.01); *B41J 11/008* (2013.01); *B41J 2/01* (2013.01)

(58) Field of Classification Search

CPC .. B41J 3/40731; B41J 3/4078; B41J 3/40733; B41J 11/02; B41J 11/057; B41J 11/42

See application file for complete search history.

(56) References Cited

U.S. PATENT DOCUMENTS

| | | | | |
|---|---|---|---|---|
| 2012/0306950 | A1 | 12/2012 | Kobayashi et al. | |
| 2013/0044148 | A1 | 2/2013 | Kobayashi | |
| 2013/0057604 | A1 | 3/2013 | Masunaga et al. | |
| 2013/0127937 | A1 | 5/2013 | Masunaga et al. | |
| 2013/0135368 | A1 | 5/2013 | Kobayashi et al. | |
| 2013/0135401 | A1 | 5/2013 | Kobayashi et al. | |
| 2013/0147867 | A1 | 6/2013 | Kobayashi et al. | |
| 2015/0158308 | A1 | 6/2015 | Kobayashi et al. | |
| 2017/0136778 | A1 | 5/2017 | Kobayashi et al. | |
| 2018/0170087 | A1 | 6/2018 | Kobayashi et al. | |
| 2018/0281464 | A1* | 10/2018 | Bradway ..... | B41J 11/02 |

FOREIGN PATENT DOCUMENTS

| | | |
|---|---|---|
| JP | 2012-240284 | 12/2012 |
| JP | 2017-170718 | 9/2017 |

* cited by examiner

*Primary Examiner* — Scott A Richmond

(74) *Attorney, Agent, or Firm* — Xsensus LLP

(57) ABSTRACT

A printer includes a head configured to discharge a liquid onto a print target, and a platen configured to hold the print target. The platen includes multiple supports arrayed in a first direction and in a second direction intersecting the first direction, and each of the multiple supports is configured to movable between a first position and a second position different from the first position.

18 Claims, 14 Drawing Sheets

PLATEN AND PRINTER

CROSS-REFERENCE TO RELATED APPLICATION

This patent application is based on and claims priority pursuant to 35 U.S.C. § 119(a) to Japanese Patent Application No. 2020-037483, filed on Mar. 5, 2020, in the Japan Patent Office, the entire disclosures of which is hereby incorporated by reference herein.

BACKGROUND

Technical Field

Aspect of the present disclosure relates to a platen and a printer.

Related Art

A printer prints on a cloth (fabric) such as a T-shirt, for example.

The printer includes a base and a plurality of convex portions protruding from the base. The printer further includes a support, a printing unit, and a movable member. The support supports a medium on tips of the plurality of convex portions.

The printer prints on the medium supported by the support. The movable member is disposed in an accommodation space and is supportable the medium. The accommodation space is a space between adjacent convex portions and is a space between the base and the printing unit.

The movable member displaces between a first state and a second state. The movable member is disposed lower than the convex portions in the first state. The movable member is disposed higher than the first state in the second state.

SUMMARY

In an aspect of this disclosure, a printer includes a head configured to discharge a liquid onto a print target, and a platen configured to hold the print target. The platen includes multiple of supports arrayed in a first direction and in a second direction intersecting the first direction, and each of the multiple supports is configured to movable between a first position and a second position different from the first position.

In another aspect of this disclosure, a printer includes a head configured to discharge a liquid onto a print target, and a platen configured to hold the print target. The platen includes multiple supports arrayed in a first direction and a second direction intersecting the first direction, a support setting part on which the multiple supports are set, a surface of the support setting part is disposed lower than surfaces of the multiple supports on the support setting part, and the multiple supports are magnetically connectable to and separatable from the support setting part.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
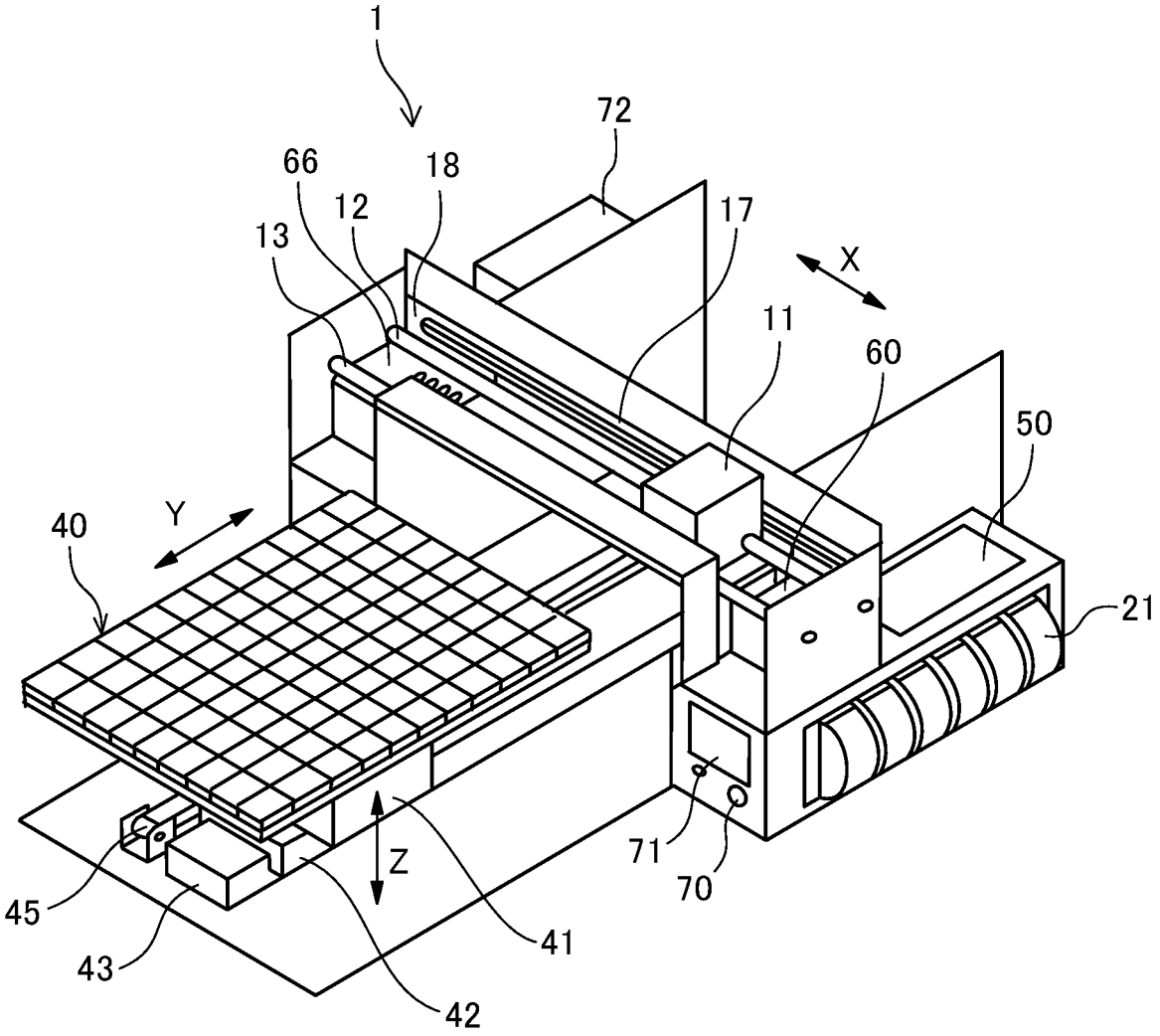
FIG. 1 is a schematic perspective view of a printer according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Referring now to the drawings, wherein like reference numerals designate identical or corresponding parts throughout the several views, embodiments of the present disclosure are described below. A printer 1 according to a first embodiment of the present disclosure is described with reference to FIGS. 1 to 3.

FIG. 1 is a schematic perspective view of the printer 1 according to the first embodiment.

Figure 2:
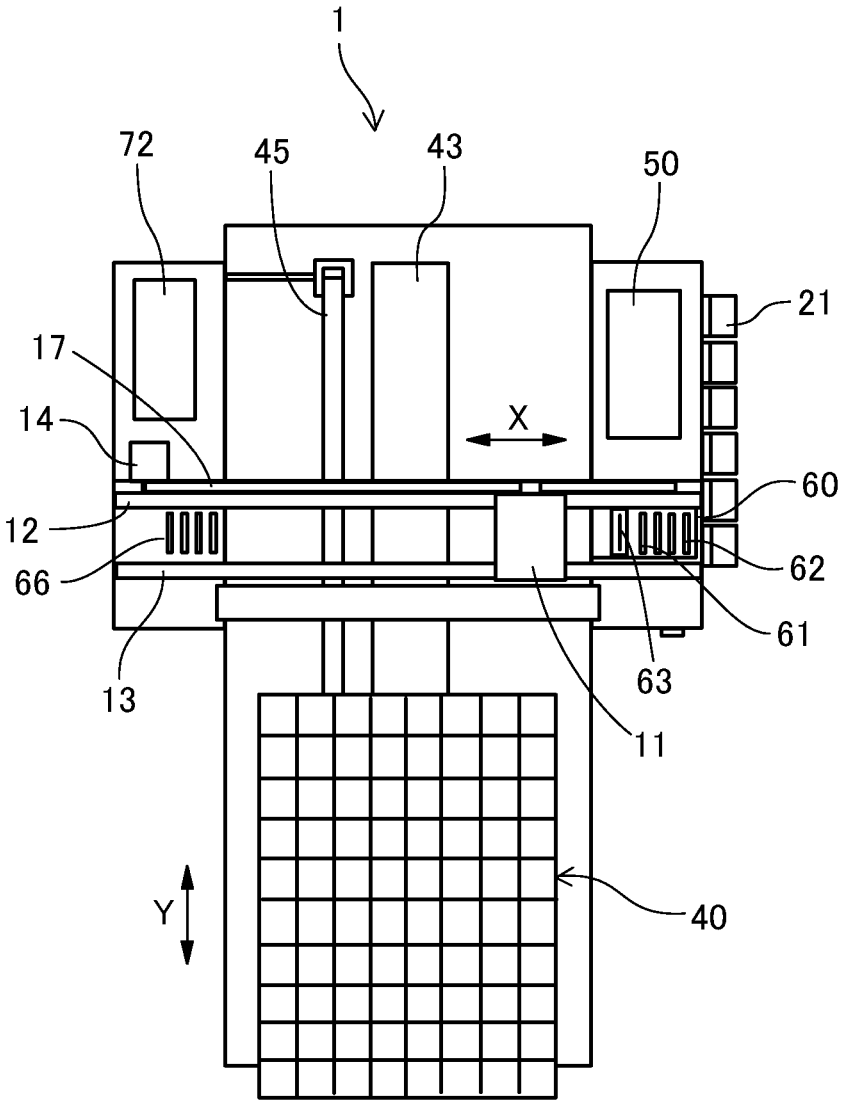
FIG. 2 is a schematic plan view of the printer of FIG. 1.

FIG. 2 is a schematic plan view of the printer 1 of FIG. 1.

Figure 3:
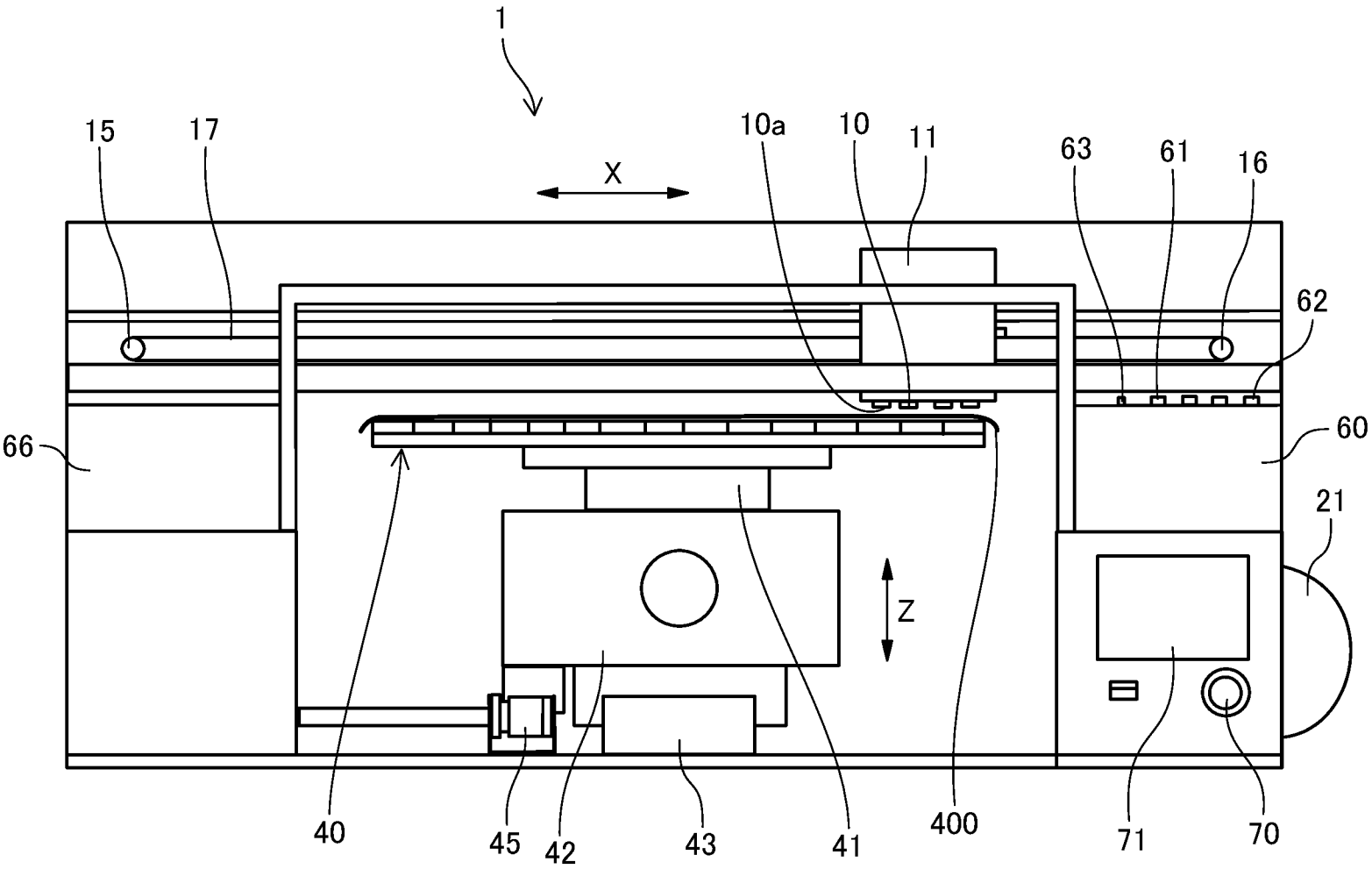
FIG. 3 is a schematic cross-sectional front view of the printer of FIG. 1.

FIG. 3 is a schematic cross-sectional front view of the printer of FIG. 1.

The printer 1 includes heads 10 (see FIG. 3) to discharge a liquid and a carriage 11 mounting the heads 10. The printer 1 includes guides 12 and 13 to hold the carriage 11 such that the carriage 11 is reciprocally movable in a main scanning direction indicated by arrow "X" in FIGS. 1 to 3. To move and scan the carriage 11 in the main scanning direction X, the carriage 11 is coupled to a timing belt 17 stretched between a drive pulley 15 rotated by a main scanning motor 14 and a driven pulley 16. As the main scanning motor 14 drives and rotates the timing belt 17 through the drive pulley 15, the timing belt 17 reciprocally moves the carriage 11 in the main scanning direction X.

The printer 1 includes an encoder sheet 18 arranged along the main-scanning direction X. The encoder sheet 18 includes slits periodically formed on the encoder sheet 18. The carriage 11 includes a reading sensor to read the slits in the encoder sheet 18. Thus, the printer 1 can detect a position of the carriage 11 in the main scanning direction X from a reading result of the reading sensor.

The printer 1 includes a controller board 50 that controls the heads 10 to discharge an ink as a liquid from the heads 10 at a timing when the carriage 11 is moved to a discharge position. A position of the carriage 11 is obtained from the reading result of the reading sensor of the carriage 11.

The printer 1 includes four heads 10 mounted on the carriage 11. Each heads includes two rows of nozzle arrays on a nozzle surface 10*a* (see FIG. 3) of the heads 10. Each nozzle arrays includes nozzles from which a liquid is discharged. The carriage 11 also mounts a sub tank to temporally store a liquid to be supplied to the head 10. A liquid of desired color is supplied from a main tank 21 to the sub tank via a supply tube by a liquid feed pump.

The printer 1 includes a platen 40 as a holder to hold a fabric 400 as a print target. The platen 40 is detachably attachable to the printer 1.

The printer 1 includes an elevator 41 on which the platen 40 is mounted so that the elevator 41 can adjust a height position of the platen 40 in a vertical direction indicated by arrow "Z" in FIGS. 1 and 3. The printer 1 includes a slider 42 on which the elevator 41 of the platen 40 is mounted.

The printer 1 includes a slider rail 43 on which the slider 42 is movably mounted. The slider rail 43 is extended along on a sub scanning direction indicated by arrow "Y." The sub scanning direction Y is perpendicular to the main scanning direction X. Thus, the slider 42 moves along the slider rail 43 in the sub-scanning direction Y.

The slider 42 is reciprocally movable in the sub scanning direction Y via the timing belt 45 by a sub scan drive mechanism. Reciprocal movement of the slider 42 in the sub scanning direction Y reciprocally moves the platen 40 in the sub scanning direction Y.

The printer 1 includes a maintenance unit 60 to maintain and recover a discharge function the head 10. The maintenance unit 60 is disposed on one side (right-side in FIG. 1) of the printer 1 in the main scanning direction X. The maintenance unit 60 includes a suction cap 61 to cap the nozzle surface 10*a* of the head 10, a moisture-retention cap 62 to cap the nozzle surface 10*a* of the head 10 to keep moisture in the nozzles of the head 10, and a wiper 63 to wipe the nozzle surface 10*a* of the head 10. The suction cap 61 is connected to a suction pump serving as a suction device.

The printer 1 includes a discharge receptacle 66 on another end (left end in FIG. 1) of the printer 1 in the main scanning direction X. The controller board 50 controls the head 10 to discharge the liquid to the discharge receptacle 66 during printing to maintain and recover a discharge function of the head 10.

Further, the printer 1 includes a power button 70, an operation part 71, a power supply unit 72, and the like.

When the printer 1 prints on a fabric (print target) such as a T-shirt, the fabric 400 is set on the platen 40. Then, the operation part 71 is operated to completely pulls the platen 40 in a rear direction (upper righthand in FIG. 1) of the printer 1 by moving the slider 42.

When the platen 40 is fully (completely) pulled inside the printer 1 (end of pull-in operation), the printer 1 becomes a print-data standby state. The printer 1 starts a print operation when the printer 1 receives print data from an external information processing device. Alternatively, the printer 1 may select the print data by the operation part 71 to start the print operation when the print data is previously stored in the controller board 50.

When the printer 1 starts the print operation, the printer 1 moves the slider 42 to move the platen 40 to a printing start position at which the printer 1 starts the print operation. Then, the printer 1 moves the carriage 11 while discharging a liquid from the head 10 to perform one line of printing on the fabric 400.

When the printer 1 prints one line, the printer 1 moves the slider 42 to move the platen 40 by one line. The printer 1 intermittently repeats one scanning movement of the carriage 11 in the main scanning direction X and one movement of the slider 42 in the sub-scanning direction Y to print an image on a desired region on the fabric 400. The printer 1 moves the platen 40 back to a front side (left side in FIG. 17) of the printer 1 to finish the print operation.

The platen 40 according to the first embodiment of the present disclosure is described with reference to FIGS. 4 to 6.

Figure 4:
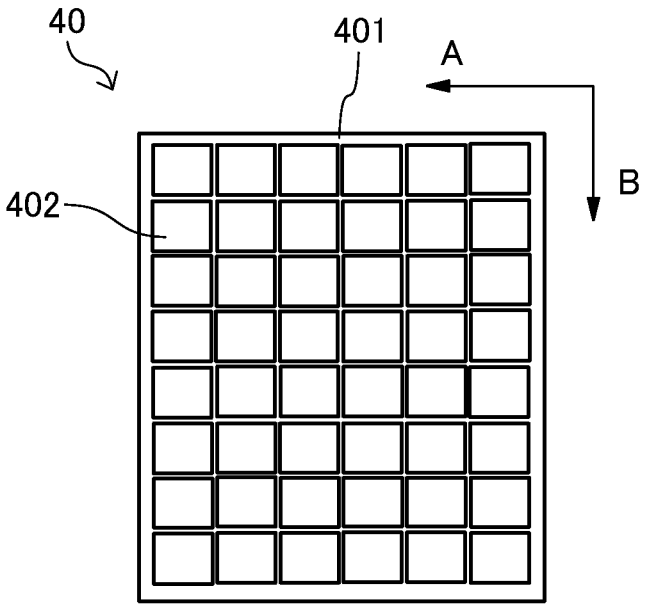
FIG. 4 is a plan view of a platen according to a first embodiment of the present disclosure.

FIG. 4 is a schematic plan view of the platen 40 according to the first embodiment.

Figure 5:
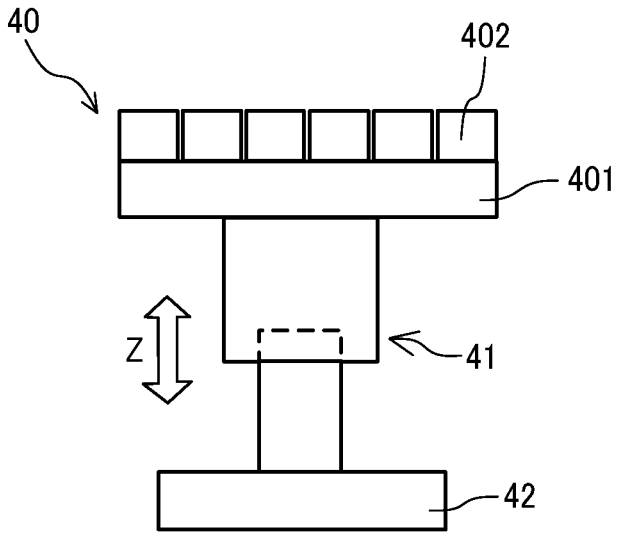
FIG. 5 is a schematic front view of the platen mounted on an elevator.

FIG. 5 is a schematic front view of the platen 40 mounted on the elevator 41.

Figure 6:
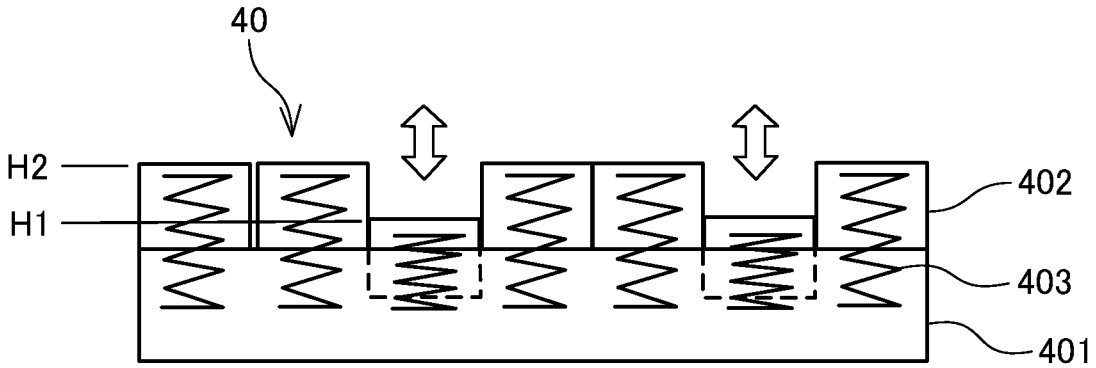
FIG. 6 is a schematic cross-sectional front view of the platen illustrating height positions of supports of the platen.

FIG. 6 is a schematic cross-sectional front view of the platen 40 illustrating height positions of supports 402 of the platen 40.

The platen 40 includes multiple supports 402 on the base 401. The multiple supports 402 support the fabric 400 as a print target. The multiple supports 402 may have divided bodies, holding bodies, or block bodies. Hereinafter, the multiple supports 402 are simply referred to as "supports 402".

The platen 40 according to the first embodiment includes the supports 402 arrayed in a first direction indicated by arrow "A" and in a second direction indicated by arrow "B" in FIG. 4. The first direction A corresponds to the main scanning direction X in FIGS. 1 to 3. The second direction B corresponds to the sub scanning direction Y in FIGS. 1 to 3. The second direction B intersects with the first direction B. More specifically, the second direction B is perpendicular to the first direction B.

However, the first direction A and the second direction B do not have to be perpendicular to each other, and the supports 402 can be arranged in a two-dimensional matrix in a plan view as illustrated in FIG. 4.

Thus, the multiple supports 402 include multiple blocks arrayed in the first direction A and the second direction B perpendicular to the first direction A, and the multiple blocks are arrayed in a two-dimensional matrix in a plan view as illustrated in FIGS. 4 and 5.

The supports 402 in the first embodiment have a rectangular (square) shape in a plan view as illustrated in FIG. 4. However, the supports 402 may have triangular, rectangular, or other shapes such as polygonal or curved shape.

As illustrated in FIG. 6, the supports 402 are movable (displaceable in a height direction) between a first position H1 and a second position H2 different from the first position H1. Thus, a top surface of each of the supports 402 individually and vertically moves (displaces) between the first position H and the second position H2. A height of the first position H1 is lower than a height of the second position H2.

Each of the supports 402 include a push spring 403 inside the supports 402. The push springs 403 push the supports 402 upward toward the second position H2 as illustrated in FIG. 6. The supports 402 have an alternate-type mechanism that alternately switches (moves and holds the fabric 400) between the first position H1 and the second position H2 each time the supports 402 are pressed.

Thus, the multiple supports 402 is configured to alternately switchable between the first position H1 and the second position H2 each time the multiple supports 402 being pressed.

An effect of the platen 40 according to the first embodiment of the present disclosure is described with reference to FIG. 7.

Figure 7:
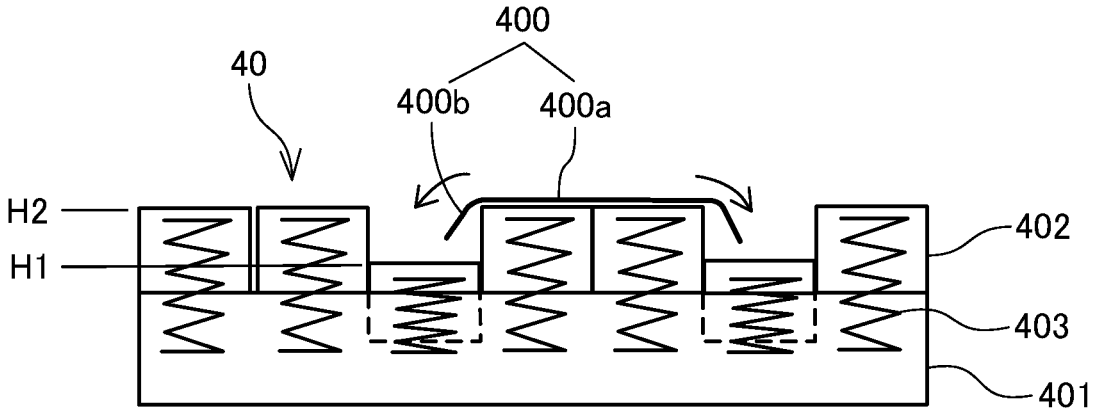
FIG. 7 is a schematic cross-sectional front view of the platen illustrating an effect of the platen according to the first embodiment of the present disclosure.

FIG. 7 is a schematic cross-sectional front view of the platen 40 illustrating the effect of the platen 40 according to the first embodiment.

As illustrated in FIG. 7, the supports 402 positioned at each end 400*b* of the fabric 400 among the supports 402, on which the fabric 400 as the print target is placed, is pressed and displaced (moved) from the second position H2 to the first position H1.

Thus, a part to be printed 400*a* (also referred to as a "print area") in the fabric 400 is held at the second position H2. The end 400*b* of the fabric 400 hangs down due to gravity.

At the time of setting the fabric 400 on the platen 40, a force in a gravity direction is applied to the end 400*b* on an entire circumference of the fabric 400 since the platen 40 includes the multiple supports 402 that are displaceable (movable) in a height direction between the first position A and the second position B.

For example, if the fabric 400 has a rectangular shape, all of four ends of the ends 400*b* hangs down so that the part to be printed 400*a* (print area) is evenly pulled outward.

Thus, a lift such as wrinkles in the part to be printed 400*a* of the fabric 400 is reduced and a surface of the part to be printed 400*a* becomes flat as illustrated in FIG. 7. That is, when the fabric 400 is set on the platen 40, the support 402 corresponding to the end 400*b* of the fabric 400 is pushed downward so that the platen 40 can ensure flatness of the part to be printed 400*a* (print area) of the fabric 400. Thus, the printer 1 according to the first embodiment can improve workability in setting the fabric 400 (print area) on the platen 40.

The platen 40 in the first embodiment ensure the flatness of the part to be printed 400*a* (print area) in the fabric 400. Thus, the platen 40 can make a gap between a printing surface of the fabric 400 and the nozzle surface 10*a* of the head 10 to substantially constant to improve print quality of the printer 1.

Further, extra supports 402 in the platen 40 are pushed downward to set the fabric 400 on the platen 40 without changing the platen 40 even when a size of the fabric 400 is smaller than an overall size of the supports 402 of the platen 40. Thus, the platen 40 can easily hold the fabric 400 (print target) having different shapes.

Next, the printer 1 according to a second embodiment of the present disclosure is described with reference to FIGS. 8 to 10.

Figure 8:
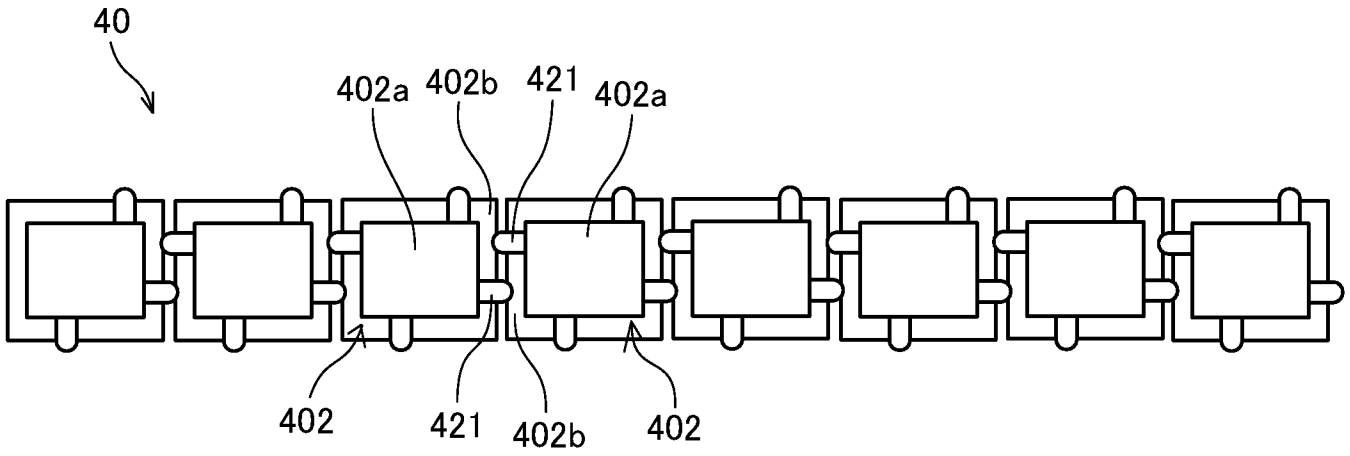
FIG. 8 is a plan view of the platen according to a second embodiment of the present disclosure.

FIG. 8 is a schematic plan view of one row of the platen 40 according to the second embodiment.

Figure 9:
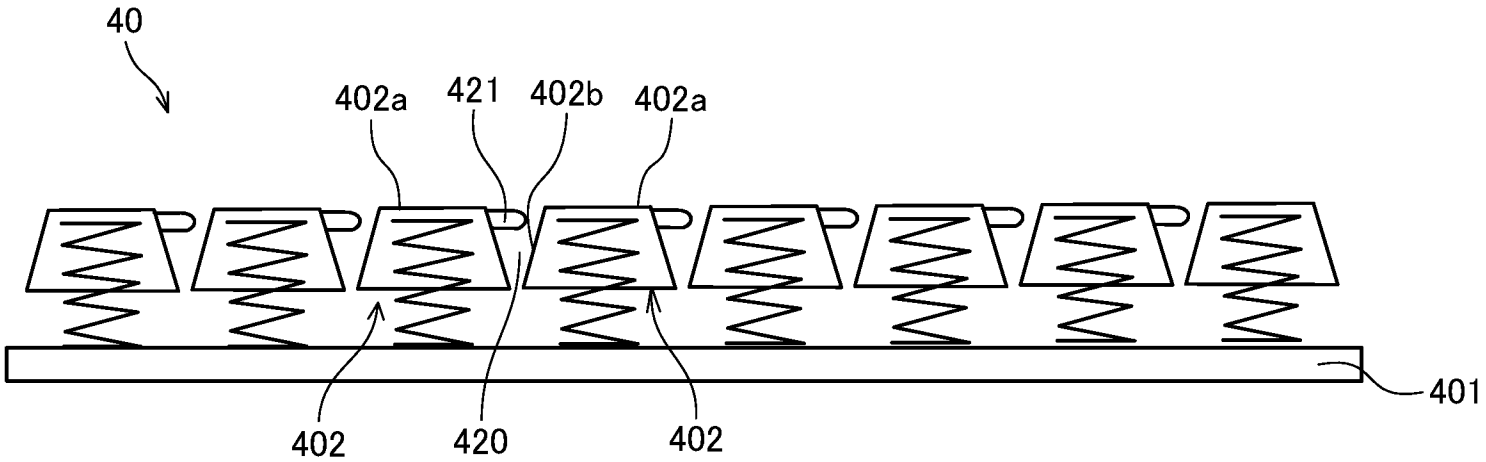
FIG. 9 is a schematic cross-sectional front view of the platen of FIG. 8.

FIG. 9 is a schematic cross-sectional front view of the platen 40 of FIG. 8.

Figure 10:
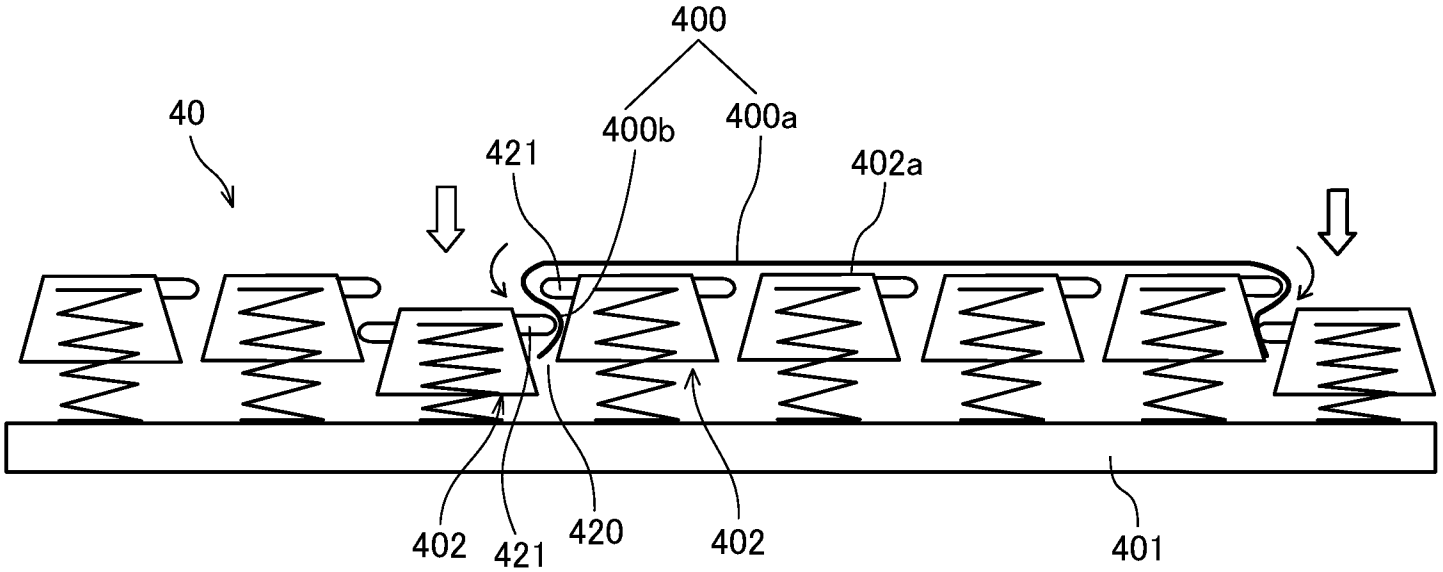
FIG. 10 is a schematic cross-sectional front view of the platen of FIG. 8 illustrating an effect of the platen according to the second embodiment of the present disclosure.

FIG. 10 is a schematic cross-sectional front view of the platen 40 to illustrate an effect of the platen 40 according to the second embodiment.

The platen 40 in the second embodiment includes gaps 420 provided between adjacent supports 402. Each of the support 402 has a trapezoidal cross-sectional shape. Each of the support 402 includes a pushing part 421 on the side surface of the support 402 to push the fabric 400 (print target) between the pushing part 421 and the side surface 402*b* of the adjacent supports 402.

The end 400*b* of the fabric 400 is inserted into the gap 420 between the pushing parts 421 of the adjacent supports 402 to set the fabric 400 on the platen 40 according to the second embodiment as illustrated in FIG. 10. Thus, the platen 40 includes gaps 420 between the multiple supports 402 adjacent to each other.

Then, the support 402 positioned at the end 400*b* of the fabric 400 is pushed and displaced (moved) to the first position H1 so that the end 400*b* of the fabric 400 in contact with the pressing part 421 is pulled downward while the end 400*b* is sandwiched between the pressing part 421 and the side surface 402*b* of the support 402.

Thus, the platen 40 can stretch the wrinkles in the fabric 400 and flatten the part to be printed 400*a* (print area) in the fabric 400. Thus, the printer 1 according to the second embodiment can improve workability in setting the fabric 400 (print area) on the platen 40.

Thus, the pushing part 421 of part of the multiple supports 402 push the fabric 400 (print target) against the side surface 402*b* of the adjacent support 402 to pinch the fabric 400 (print target) between the pushing part 421 and the side surface 402*b* of the adjacent support 402 as the part of the multiple supports 402 move from the second position H2 to the first position H1 lower than the second position H2.

The pressing part 421 is formed of a member having a frictional resistance higher than a friction resistance of the top surface 402*a* of the support 402. The top surface 402*a* is a surface of the support 402 on which the fabric 400 (print target) is placed. For example, the pressing part 421 is preferably made of a member having an uneven surface, or a member having a high frictional resistance such as a material itself such as rubber.

Further, the supports 402 of the platen 40 according to the second embodiment has a trapezoidal cross-sectional shape so that the gap 420 between the adjacent supports 402 has a shape in which an upper side of the gap 420 is wider than a lower side of the gap 420 as illustrated in FIGS. 9 and 10.

The support 402 having the trapezoidal cross-sectional shape enable the end 400*b* of the fabric 400 to be inserted into the gap 420 between the adjacent supports 402.

Further, when the support 402 is pushed and displaced (moved) from the second position H2 to the first position H1 as illustrated in FIG. 10, the gap 420 between the adjacent supports 402 at the first position H1 becomes narrower than the gap 420 between the adjacent supports 402 at the second position H1. More specifically, the gap 420 is between the pressing part 421 on the side surface 402*b* of the support 402 and the side surface 402*b* of the adjacent support 402 (see FIG. 10).

With a downward displacement (movement) of the support 402 when the support is pushed downward, a strength of the force to pull the fabric 400 (print target) gradually increases. Thus, the platen 40 can prevent overpulling of the fabric 400 (print target) and reduce an extension (stretching) of the part to be printed 400*a* of the fabric 400 (print target).

Further, the platen 40 according to the second embodiment includes the pressing parts 421 alternately formed on opposite side surfaces 402*b* of the adjacent supports 402 in an array direction (the first direction A and the second direction B) of the supports 402.

Thus, only a part of the gap 420 between the adjacent supports 402 is narrowed so that the end 400*b* of the fabric 400 (print targe) is easily held (pinched) by the supports 402.

Next, the platen 40 according to a third embodiment of the present disclosure is described with reference to FIGS. 11A and 11B.

Figure 11B:
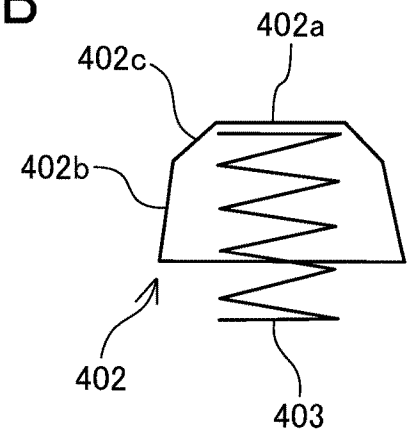
FIGS. 11A and 11B are schematic cross-sectional front views of the platen illustrating a different example of the supports of the platen according to the third embodiment of the present disclosure.
Figure 11A:
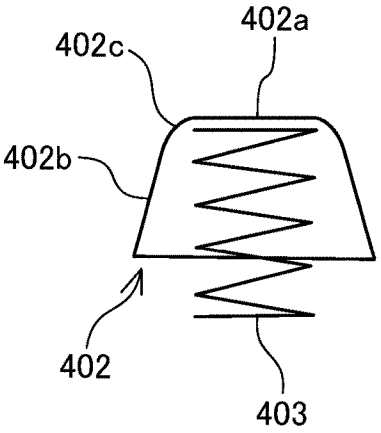

FIGS. 11A and 11B are schematic cross-sectional front views of the platen 40 illustrating a different example of the supports 402 of the platen 40 according to the third embodiment.

The support 402 in the platen 40 according to a first example illustrated in FIG. 11A includes a corner 402*c* formed between a top surface 402*a* and a side surface 402*b* of the support 402. The corner 402*c* has a round shape (R-shape) or a round surface shape. The support 402 in the platen 40 according to a second example illustrated in FIG. 11B includes a corner 402*c* formed between a top surface 402*a* and a side surface 402*b* of the support 402. The corner 402*c* has a diagonal shape (inclined shape) or diagonal surface shape. The diagonal shape is also referred to as a "C-shape."

Thus, when the end 400*b* of the fabric 400 (print target) is pulled, the fabric 400 (print target) does not get caught in the corner 402*c* between the top surface 402*a* and the side surface 402*b* of the support 402. Further, it is easier to insert the end 400*b* of the fabric 400 (print target) into the gap 420 between the adjacent supports 402.

Next, the printer 1 according to a fourth embodiment of the present disclosure is described with reference to FIG. 12.

Figure 12:
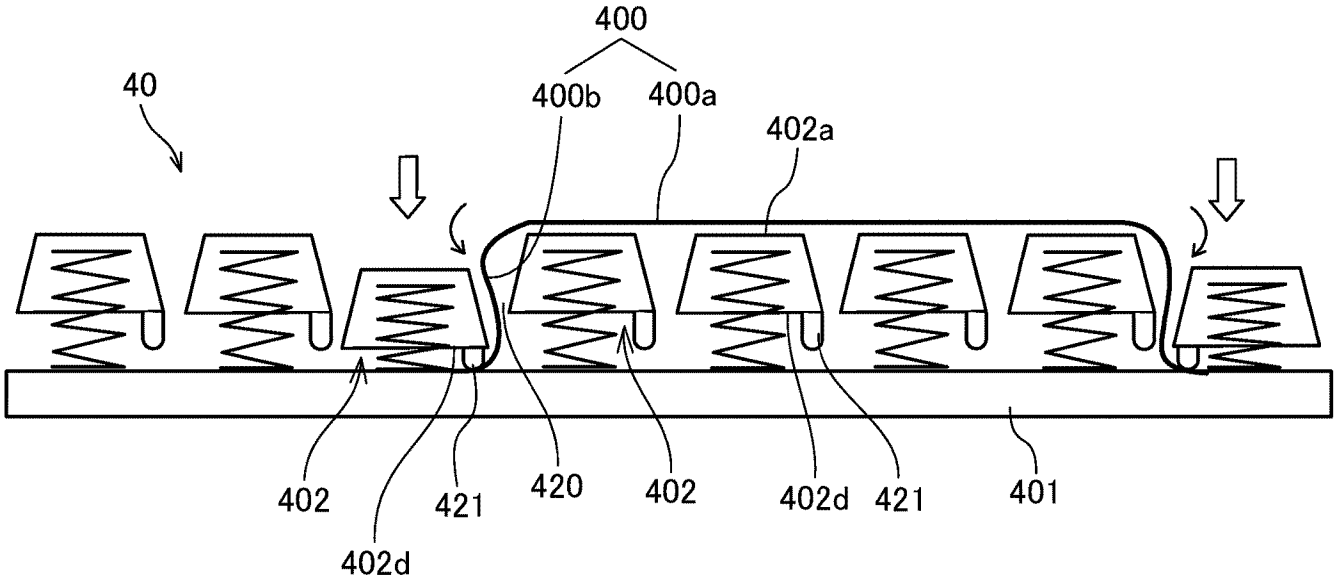
FIG. 12 is a schematic cross-sectional front view of the platen according to a fourth embodiment of the present disclosure.

FIG. 12 is a front view of the platen 40 according to the fourth embodiment.

Each of the support 402 includes the pushing part 421 on a bottom surface 402*d* of the support 402 to push and hold (pinch) the fabric 400 (print target) between the pushing part 421 and the base 401.

When the end 400*b* of the fabric 400 is inserted into the gap 420 between the adjacent supports 402 and the support 402 is pushed downward and is displaced to the first position H1 as indicated by arrow in FIG. 12, the pushing part 421 pushes the end 400*b* of the fabric 400 to the base 401 and pulls in (draws in) the end 400*b* of the fabric 400 downward toward the base 401.

Thus, the platen 40 according to the fourth embodiment can stretch and flatten the wrinkles of the part to be printed 400*a* (print area) of the fabric 400.

Thus, the platen 40 includes the base 401 on which the multiple supports 402 are arrayed, and each of the multiple supports 402 includes a pushing part 421 on a bottom surface 402*d* of the multiple support 402. The pushing part 421 pinches the fabric 400 (print target) between the pushing part 421 and the base 401.

Further, the pushing part 421 of a part of the multiple supports 402 pushes the fabric 400 (print target) against the base 401 to pinch the fabric 400 (print target) between the pushing part 421 and the base 401 as the part of the multiple supports 402 moves from the second position H2 to the first position H1 lower than the second position H2.

Next, the printer 1 according to a fifth embodiment of the present disclosure is described with reference to FIG. 13.

Figure 13:
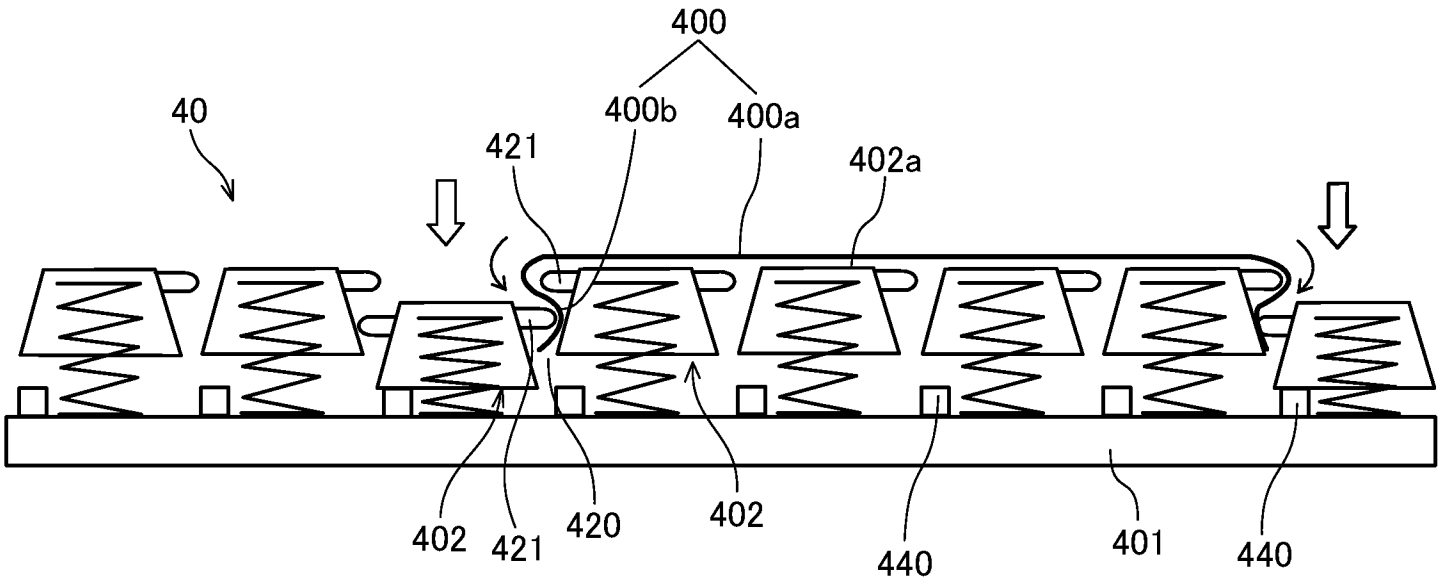
FIG. 13 is a schematic cross-sectional front view of the platen according to a fifth embodiment of the present disclosure.

FIG. 13 is a front view of the platen 40 according to the fifth embodiment.

The platen 40 according to the fifth embodiment includes multiple detectors 440 to respectively detect displacements of the multiple supports 402 from the second position H2 to the first position H1 in addition to a configuration of the second embodiment (or may be any other above-described embodiments) as illustrated in FIGS. 8 to 10. The platen 40 includes a multiple detectors 440 corresponding to the multiple supports 402.

The detector 440 may be composed of, for example, a push switch type sensor that is turned on when the detector 440 is pressed by the support 402. Alternatively, the detector 440 may include an energization detection type sensor if the support 402 is made of a conductive member such as metal, for example.

As described above, the platen 40 according to the fifth embodiment includes the detectors 440 to detect a displacement (displacement position) of the support 402. Thus, the printer 1 can specify an approximate print area from a set of the supports 402 at the second position H2 that is disposed inside the supports 402A at the first position H1 that surrounds the supports 402 at the second position H2 (see FIG. 13).

Thus, the print area specification device 801 (circuitry) specifies the print area from a set of the multiple supports 402 at the second position H2 surrounded by the multiple supports 402A at the first position H1.

Thus, the multiple detectors 440 configured to respectively detect a first part of the multiple supports 402A at the first position H1, and the print area specification device 801 (circuitry) specifies the print area from an area consisting of a second part of the multiple supports 402B at the second position H2 surrounded by the first part of the multiple supports 402A at the first position H1.

The supports 402 at the second position H2 support the part to be printed 400*a* (print area) of the fabric 400. The supports 402 at the first position H1 holds (pinches) the end 400*b* of the fabric 400 by the pushing part 421 of a first support 402 and the side surface 402*b* of a second support 402 adjacent to the first support 402.

Figure 14B:
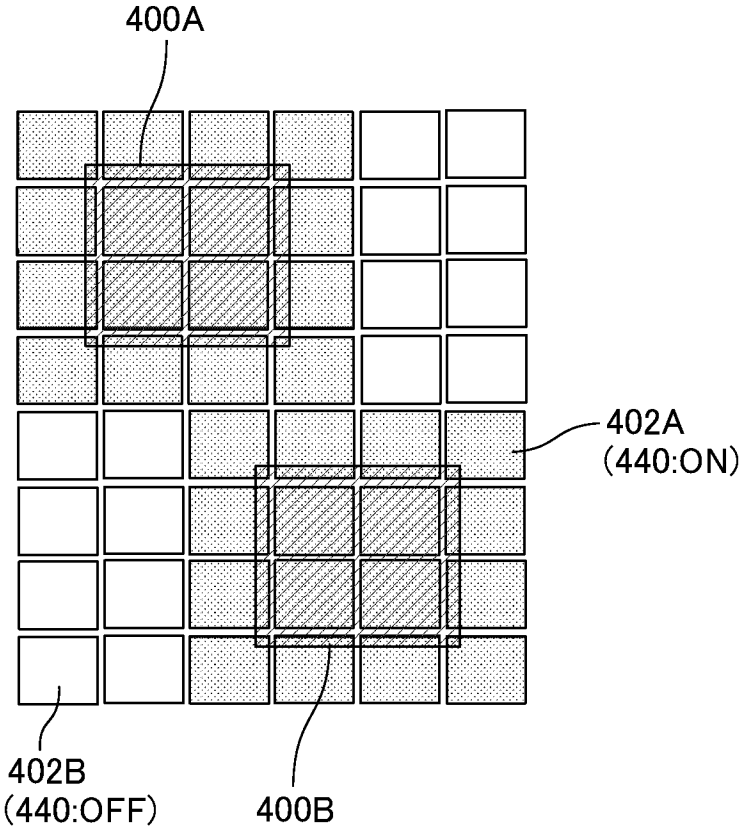
FIGS. 14A and 14B are schematic plan views of the platen according to a sixth embodiment of the present disclosure.
Figure 14A:
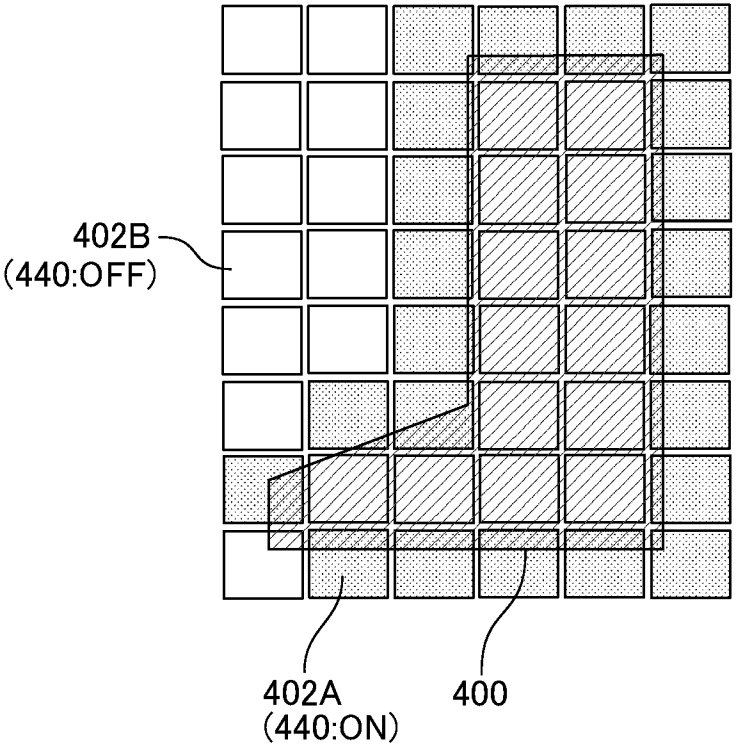

Next, the platen 40 according to a sixth embodiment of the present disclosure is described with reference to FIGS. 14A and 14B. FIGS. 14A and 14B are schematic plan views of the platen 40 according to the sixth embodiment of the present disclosure.

The platen 40 according to the sixth embodiment includes the above-described detectors 440 according to the fifth embodiment.

Further, as illustrated in FIG. 14, the supports 402 in the platen 40 can press the end 400*b* of the fabrics 400, 400A, and 400B according to a shape and a print area of the fabrics 400, 400A, 400B, and the like.

The detectors 440 of the supports 402 detect that the support 402 is displaced from the second position H2 to the first position H1 when one of the fabrics 400, 400A, and 400B is set on the platen 40. The detectors 440 of the supports 402 at the first position H1 are in an "ON" state, and the detectors 440 of the support 402 at the second position H2 are in an "OFF" state. In FIGS. 14A and 14B, the supports 402, the detectors 440 of which are in the ON state, are referred to as "supports 402A." In FIGS. 14A and 14B, the supports 402, the detectors 440 of which are in the OFF state, are referred to as "supports 402B".

Thus, the printer 1 can specify an approximate print area from a set of the supports 402B at the second position H2 that is disposed inside the supports 402A at the first position H1 that surround the supports 402B at the second position H2. For example, a controller (control device) mounted on the controller board 50 may specify the print area, for example, Next, the printer 1 according to a seventh embodiment of the present disclosure is described with reference to FIG. 15.

Figure 15:
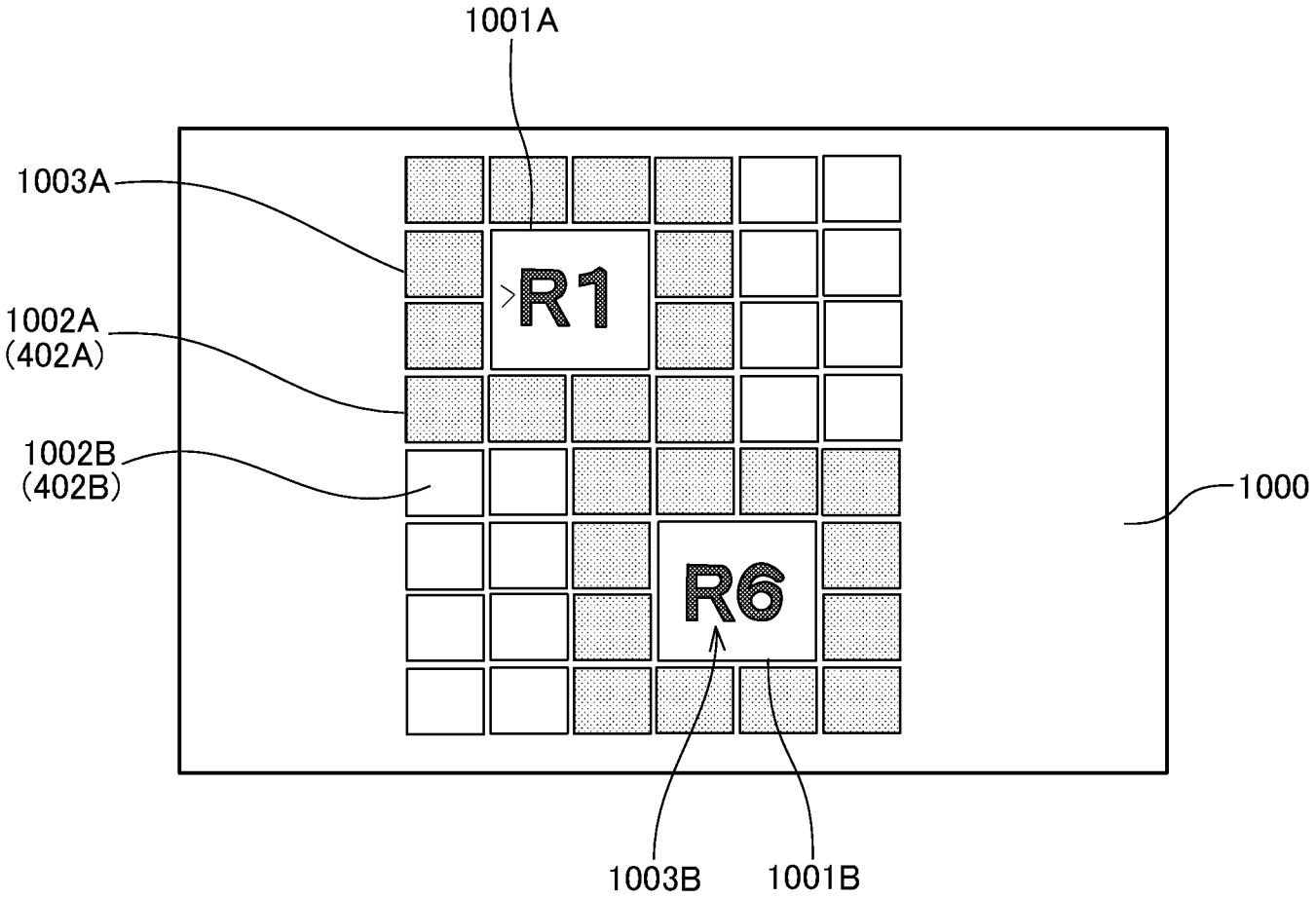
FIG. 15 is a schematic plan view of the platen according to a seventh embodiment of the present disclosure.

FIG. 15 is a schematic plan view of the platen 40 according to the seventh embodiment.

The platen 40 according to the seventh embodiment includes the above-described detectors 440 according to the fifth embodiment.

Further, the operation part 71 includes a screen 1000 such as a display 802 (operation part monitor). The print area specification device 801 (circuitry) controls the operation part 71 to display print areas 1001A and 1001B and print images 1003A and 1003B to be printed on the fabric 400 (print target) on the screen 1000 of the display 802.

Thus, the print area specification device 801 (circuitry) is configured to control the display 802 to display the print areas 1001A and 1001B and the print images 1003A and 1003B to be printed on the fabric 400 (print target) according to detection results of the plurality of detectors 440.

Further, the print area specification device 801 (circuitry) controls the operation part 71 to display an image 1002A and an image 1002B on the screen 1000 of the display 802 in different colors, for example. The image 1002A corresponds to the supports 402A displaced to the first position H1. The image 1002B corresponds to the supports 402B at the second position H2.

That is, the printer 1 may set and print a plurality of small fabrics 400A and 400B on the platen 40 having a large area. If positions of the fabrics 400A and 400B set on the platen 40 are incorrect, it is difficult to determine the print images at appropriate positions with respect to the fabrics 400A and 400B set on the platen 40.

Thus, the operation part 71 displays an image capable of determining an arrangement of the supports 402 and whether the support 402 is at the first position H1 or the second position H2 by color coding or the like on the screen 1000 of the display 802 (operation part monitor). The operation part 71 may also display the image capable of determining the arrangement of the supports 402 and whether the support 402 is at the first position H1 or the second position H2 on a monitor screen of an information processing device such as a personal computer connected to the printer 1.

Thus, the user can place the print images 1003A and 1003B at appropriate positions and print the print images 1003A and 1003B on the fabric 400 set on the platen 40 while visually observing the monitor screen. Thus, the printer 1 according the seventh embodiment can reduce misalignment of the print image 1003A and 1003B with respect to the fabric 400 (print target) to improve print quality.

Figure 16:
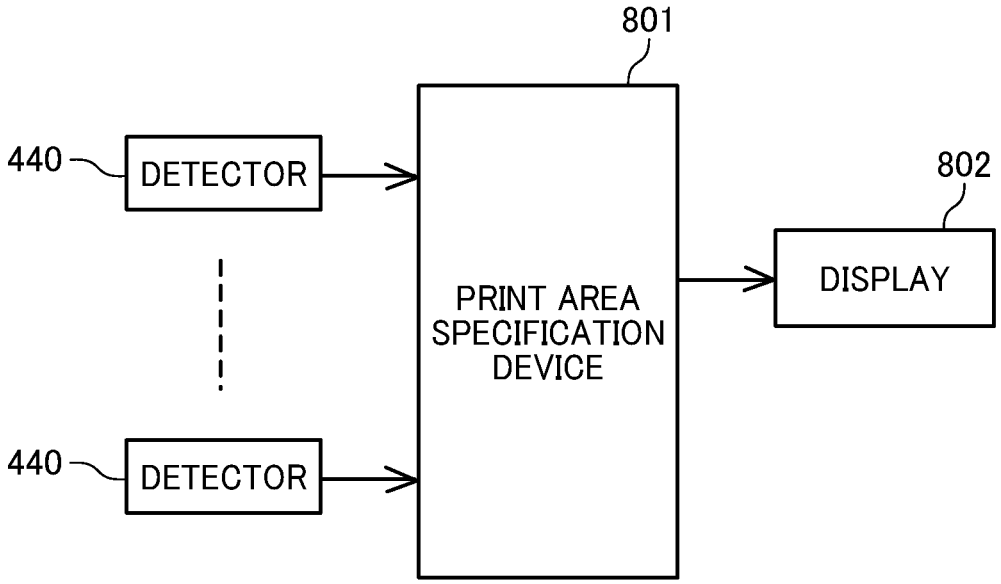
FIG. 16 is a block diagram of a controller to control the print area according to the fifth to seventh embodiments of the present disclosure.

FIG. 16 is a schematic block diagram of a part to control a specification of the print area in the fifth to seventh embodiments of the present disclosure.

The printer 1 includes a print area specification device 801 to input detection results (ON state or OFF state) of the plurality of detectors 440, specify the print area from the positions of the detectors 440, that are the positions of the supports 402, and display the positions of the detectors 440 (supports 402) on a display 802.

Thus, the display 802 includes a display (operation part monitor) or screen 1000 (see FIG. 15) of the operation part 71 or the monitor of the information processing device connected to the printer 1 as described above.

Next, the platen 40 according an eighth embodiment of the present disclosure is described with reference to FIG. 17.

Figure 17:
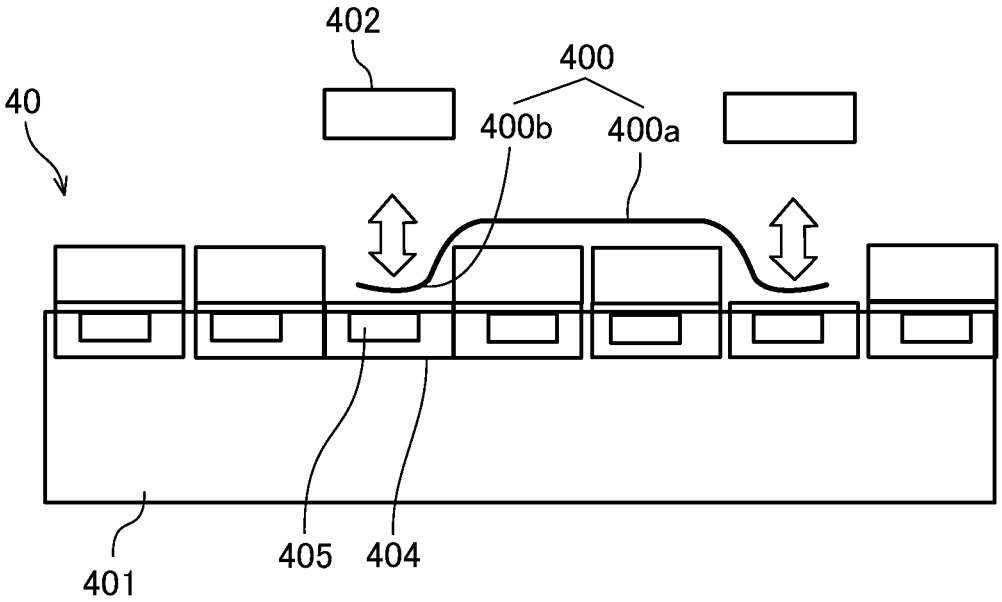
FIG. 17 is a schematic cross-sectional front view of the platen according to an eighth embodiment of the present disclosure.

FIG. 17 is a schematic cross-sectional front view of the platen 40 according to the eighth embodiment.

The platen 40 includes the supports 402 and a support setting part 404 on which the support 402 is set. The support 402 is made of a magnetic material. Further, the platen 40 includes a magnet 405 arranged on each of the support setting part 404. Thus, the support 402 and the magnet 405 on the support setting part 404 are magnetically connectable and separatable. A position of a top surface of the support 402 corresponds to the second position H2, and a position of a top surface of the support setting part 404 corresponds to the first position H1.

First, the support 402 of a part corresponding to the end 400*b* of the fabric 400 is removed according to the platen 40 in the eighth embodiment. Then, the part to be printed 400*a* (print area) of the fabric 400 is placed on the support 402 in the eighth embodiment. Then, the end 400*b* of the fabric 400 is hung on the support setting part 404 from which the support 402 is removed. Then, the support 402 removed from the support setting part 404 is set again on the support setting part 404 on which the end 400*b* of the fabric 400 is placed.

Thus, a magnetic force of the magnet 405 couples the support 402 and the magnet 405 of the support setting part 404 to fix the support 402 on the support setting part 404. Thus, the platen 40 can press and hold the end 400*b* of the fabric 400 on the support setting part 404.

Next, the platen 40 according to a ninth embodiment of the present disclosure is described with reference to FIG. 18.

Figure 18:
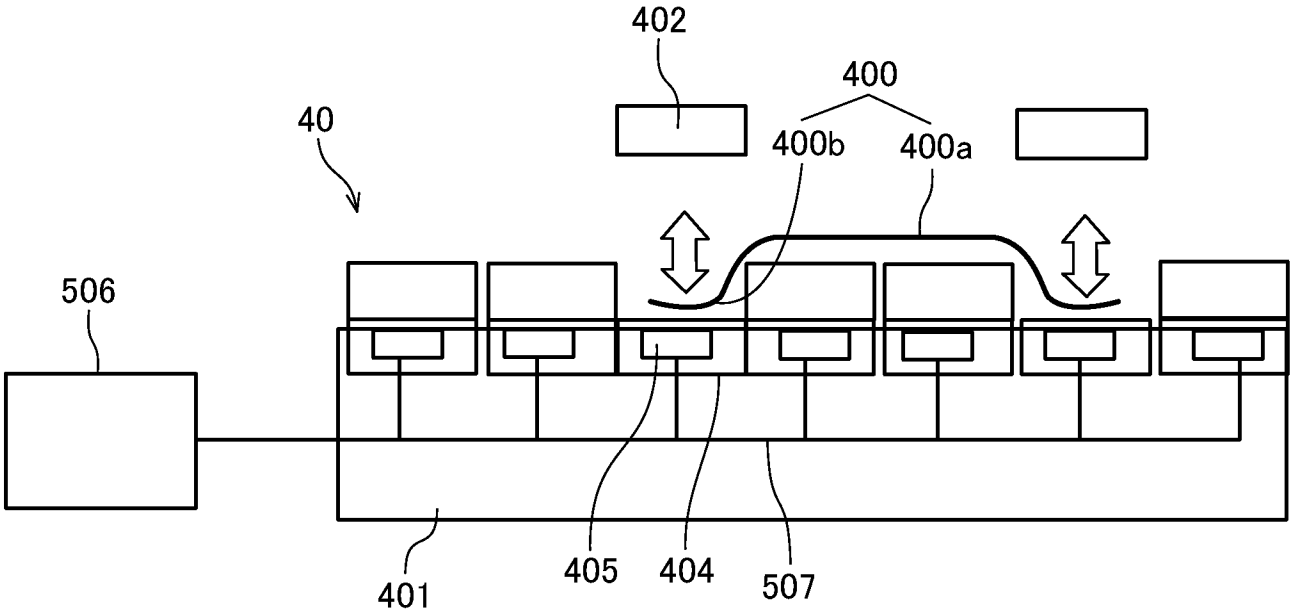
FIG. 18 is a schematic cross-sectional front view of the platen according to a ninth embodiment of the present disclosure.

FIG. 18 is a schematic cross-sectional front view of the platen 40 according to the ninth embodiment.

The platen 40 according to the ninth embodiment includes the magnet 405 as an electromagnet instead of the magnet 405 according to the eighth embodiment. The platen 40 includes a magnet generator 506 and an electric wire 507 to connect the magnet generator 506 and each of the magnet 405. The magnet generator 506 generates electricity supplied to the magnets 405 via the electric wire 507. Thus, the magnets 405 generates a magnetic force by the electricity supplied from the magnetic generator 506 via the electric wire 507 to couple the support 402 and the magnet 405.

Thus, when the fabric 400 is set on the platen 40, the magnet 405 can be kept in a state without generating the magnetic force so that the support 402 can be easily removed from the support setting part 404.

Next, the platen 40 according to a tenth embodiment of the present disclosure is described with reference to FIG. 19.

Figure 19:
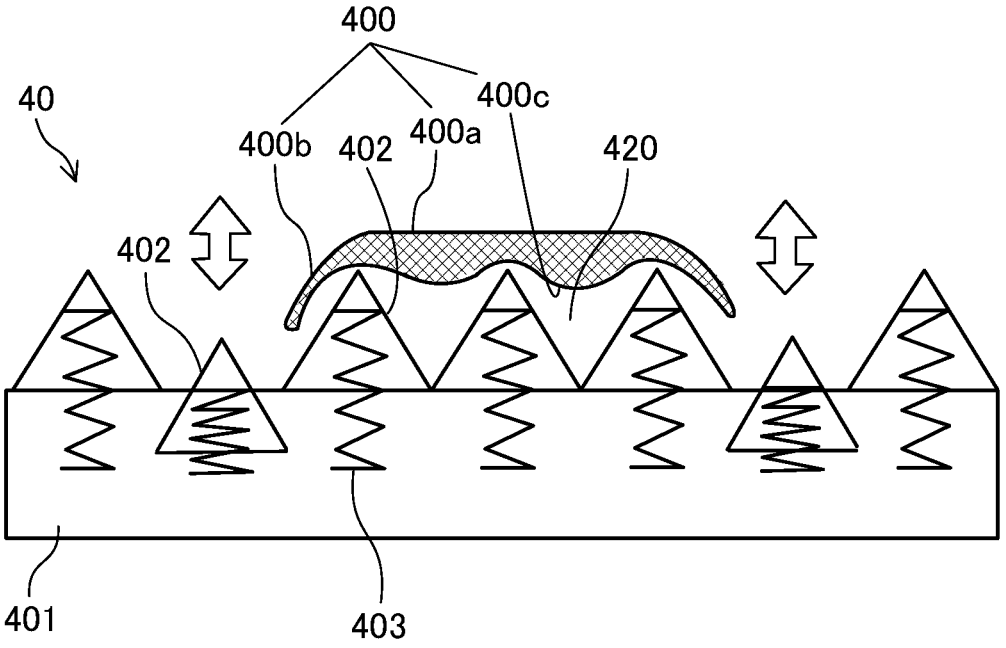
FIG. 19 is a schematic cross-sectional front view of the platen according to a tenth embodiment of the present disclosure.

FIG. 19 is a schematic cross-sectional front view of the platen 40 according to the tenth embodiment.

The supports 402 in the tenth embodiment has a polygonal pyramid shape such as a conical shape or a triangular pyramid shape, for example, as illustrated in FIG. 19.

The support 402 with this configuration can hold the fabric 400 at an upper apex 402*e* of the support 402. Further, the platen 40 according to the tenth embodiment can increase the gap 420 between the adjacent supports 402.

Thus, the platen 40 can keep the flatness of the part to be printed 402*a* (print area) even when a convex portion of a contact surface 400*c* of the fabric 400 to contact with the platen 40 is disposed lower than the second position H2 such as the contact surface 400*c* of the fabric 400 has many uneven shape or when the fabric 400 has many wrinkles.

Next, the platen 40 according to an eleventh embodiment of the present disclosure is described with reference to FIG. 20.

Figure 20:
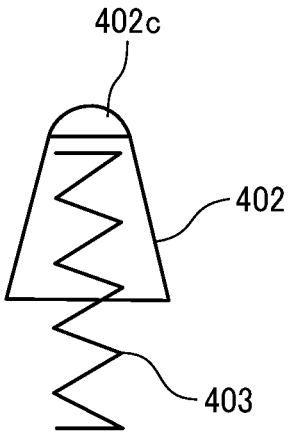
FIG. 20 is a schematic cross-sectional front view of the supports of the platen according to an eleventh embodiment of the present disclosure.

FIG. 20 is a schematic cross-sectional front view of the supports 402 of the platen 40 according to the eleventh embodiment. Only one support 402 is illustrated in FIG. 20, however, the platen 40 includes a plurality of supports 402 as illustrated in FIG. 19.

The support 402 according to the eleventh embodiment has a conical shape as in the support 402 according to the tenth embodiment (see FIG. 19) and includes the apex 402*e* having a rounded shape.

Thus, when the fabric 400 is set on the platen 40, the fabric 400 does not get caught in the apex 402*e* of the support 402. Thus, the fabric 400 can be set on the platen 40 while sliding the fabric 400 on the apex 402*e* of the support 402 to facilitate setting of the fabric 400 on the platen 40.

In each of the above described first to eleventh embodiments, the platen 40 that supports the fabric 400 is used for a fixing process after a printing process. Thus, it is preferable that the platen 40 is detachably attached to the base 401 of the printer 1 so that the platen 40 and the fabric 400 held by the platen 40 can be detached together from the base 401 of the printer 1 and are moved and attached to a heater for the fixing process to improve workability.

During a detachment process of the platen 40 from the base 401, the platen 40 according to the eleventh embodiment is effectively used to keep the part to be printed 400*a* (print area) of the fabric 400 to be flat without falling the fabric 400 from the platen 40 when the platen 40 is moved from the printer 1 to the heater. The part to be printed 400*a* (print area) is also a target surface of the fabric 400 to be heated and fixed by the heater.

Although the printer in the above-described embodiments prints on the fabric, an object to be printed is not limited to the fabric.

Further, the printer according to the present embodiments may also be applied to a printer that sets an object to be printed other than a fabric on a support to print an image on the object to be printed.

The term "liquid discharge apparatus" used herein also represents an apparatus including the head or the liquid discharge device to drive the head to discharge liquid.

The liquid discharge apparatus may be, for example, an apparatus capable of discharging liquid to a material onto which liquid can adhere and an apparatus to discharge liquid toward gas or into liquid.

The "liquid discharge apparatus" may include devices to feed, convey, and eject the material onto which liquid can adhere.

The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures.

For example, the liquid discharge apparatus may be an apparatus to form arbitrary images, such as arbitrary patterns, or fabricate three-dimensional images.

The above-described term "material onto which liquid can adhere" represents a material on which liquid is at least temporarily adhered, a material on which liquid is adhered and fixed, or a material into which liquid is adhered to permeate.

Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell.

The "material onto which liquid can adhere" includes any material on which liquid is adhered, unless particularly limited.

Examples of the "material onto which liquid can adhere" include any materials on which liquid can adhere even temporarily, such as paper, thread, fiber, fabric, leather, metal, plastic, glass, wood, and ceramic.

The "liquid discharge apparatus" may be an apparatus to relatively move the head and a material onto which liquid can adhere.

However, the liquid discharge apparatus is not limited to such an apparatus.

For example, the "liquid discharge apparatus" may be a serial head apparatus that moves the head, a line head apparatus that does not move the head, or the like.

Examples of the "liquid discharge apparatus" further include a treatment liquid coating apparatus to discharge a treatment liquid to a sheet to coat the treatment liquid on a sheet surface to reform the sheet surface.

The terms "image formation", "recording", "printing", "image printing", and "fabricating" used herein may be used synonymously with each other.

Each of the functions of the described embodiments such as the print area specification device 801 and the controller board 50 may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A printer comprising:

a head configured to discharge a liquid onto a print target; and a platen configured to hold the print target, wherein the platen comprises:

multiple supports arrayed in a first direction and in a second direction intersecting the first direction, and each of the multiple supports is movable between a first position and a second position different from the first position, the multiple supports include multiple blocks arrayed in the first direction and the second direction perpendicular to the first direction, and the multiple blocks are arrayed in a two-dimensional matrix in a plan view.

2. The printer according to claim 1, wherein the first position is lower than the second position in a vertical direction, and each of the multiple supports is individually and vertically movable between the first position and the second position.

3. The printer according to claim 1, wherein the platen includes gaps between the multiple supports adjacent to each other.

4. The printer according to claim 1, wherein each of the multiple supports includes a pushing part on a side surface thereof, the pushing part is configured to push the print target against a side surface of an adjacent support to pinch the print target between the pushing part and the side surface of the adjacent support.

5. The printer according to claim 4, wherein the pushing part of a part of the multiple supports pushes the print target against the side surface of the adjacent support to pinch the print target between the pushing part and the side surface of the adjacent support as the part of the multiple supports moves from the second position to the first position lower than the second position.

6. The printer according to claim 4, wherein a frictional resistance of the pushing part is higher than a friction resistance of a top surface of the multiple supports on which the print target is placed.

7. The printer according to claim 1, wherein each of the multiple supports includes a corner formed between a top surface and a side surface thereof, and the corner has a round shape.

8. The printer according to claim 1, wherein each of the multiple supports includes a corner formed between a top surface and a side surface thereof, and the corner has a diagonal shape.

9. The printer according to claim 1, wherein the platen further comprises a base on which the multiple supports are arrayed, and each of the multiple supports includes a pushing part on a bottom surface thereof, the pushing part is configured to push the print target against the base to pinch the print target between the pushing part and the base.

10. The printer according to claim 9, wherein the pushing part of a part of the multiple supports pushes the print target against the base to pinch the print target between the pushing part and the base as the part of the multiple supports moves from the second position to the first position lower than the second position.

11. The printer according to claim 1, further comprising:

circuitry configured to specify a print area of a print image in the print target held by the platen, wherein the platen further comprises:

multiple detectors configured to respectively detect a first part of the multiple supports at the first position, and the circuitry specifies the print area from an area consisting of a second part of the multiple supports at the second position surrounded by the first part of the multiple supports at the first position.

12. The printer according to claim 11, further comprising:

a display, wherein the circuitry is configured to control the display to display the print area according to detection results of the multiple detectors.

13. The printer according to claim 11, further comprising:

a display, wherein the circuitry is configured to control the display to display the print area and the print image according to detection results of the plurality of detectors.

14. The printer according to claim 1, wherein each of the multiple supports is alternately switchable between the first position and the second position each time being pressed.

15. The printer according to claim 1, wherein the platen is detachably attachable to the printer.

16. A printer comprising:

a head configured to discharge a liquid onto a print target; and a platen configured to hold the print target, wherein the platen comprises:

multiple supports arrayed in a first direction and a second direction intersecting the first direction, a support setting part on which the multiple supports are set, a surface of the support setting part is disposed lower than surfaces of the multiple supports on the support setting part, and the multiple supports are magnetically connectable to and separatable from the support setting part.

17. The printer according to claim 16, wherein the platen further comprises a magnet on the support setting part.

18. A printer comprising:

a head configured to discharge a liquid onto a print target; and a platen configured to hold the print target, wherein the platen comprises:

multiple supports arrayed in a first direction and in a second direction intersecting the first direction, and each of the multiple supports is movable between a first position and a second position different from the first position, and each of the multiple supports is alternately switchable between the first position and the second position each time being pressed.

* * * * *